US005640229A

United States Patent [19]

Nakahara

[11] Patent Number: 5,640,229

[45] Date of Patent: Jun. 17, 1997

[54] IMAGE FORMING APPARATUS HAVING A POSITIONING DEVICE FOR A DEVELOPING UNIT

[75] Inventor: Tomotoshi Nakahara, Kawasaki, Japan

[73] Assignee: Ricoh Company, Ltd., Tokyo, Japan

[21] Appl. No.: 340,297

[22] Filed: Nov. 14, 1994

[30] Foreign Application Priority Data

Nov. 12, 1993 [JP] Japan ..... 5-306039

[51] Int. Cl.[6] ..... G03G 15/00

[52] U.S. Cl. ..... 399/119

[58] Field of Search ..... 355/200, 245, 355/260; 222/DIG. 1

[56] References Cited

U.S. PATENT DOCUMENTS

| | | | |
|---|---|---|---|
| 4,174,050 | 11/1979 | Saito | 222/43 |
| 4,386,838 | 6/1983 | Hirabayashi et al. | 355/200 |
| 4,862,212 | 8/1989 | Tanzawa et al. | 355/245 |
| 4,970,561 | 11/1990 | Mizuno | 355/326 |
| 5,089,849 | 2/1992 | Hiraoka | 355/211 |
| 5,419,468 | 5/1995 | Taki | 222/554 |
| 5,479,245 | 12/1995 | Hino et al. | 355/245 |
| 5,499,082 | 3/1996 | Watanabe et al. | 355/245 |

*Primary Examiner*—William J. Royer

*Attorney, Agent, or Firm*—Oblon, Spivak, McClelland, Maier & Neustadt, P.C.

[57] ABSTRACT

An image forming apparatus, and particularly an improved mounting arrangement for a developing unit of an image forming apparatus is provided. The image forming apparatus includes axis supporting members which support the axes of the developing rollers on side plates of the image forming apparatus, with each of the axis supporting members including holes which receive a respective axis of the developing rollers. In a particularly preferred form, a pair of holes are provided, one of which is in the form of a round hole or circular hole, with the other in the form of an elongated or arcuate hole or slot. The circular hole and arcuate hole are disposed such that a predetermined relationship is provided between the axis of the developing rollers and the axis of the photoconductive member, e.g., a photoconductive drum, thereby ensuring a desired gap is provided between the developing rollers and the photoconductive member, despite variations which may occur in the spacing between the axes of the developing rollers (or along the axes of the developing rollers).

26 Claims, 4 Drawing Sheets

IMAGE FORMING APPARATUS HAVING A POSITIONING DEVICE FOR A DEVELOPING UNIT

BACKGROUND OF THE INVENTION

1. Field of the Invention

The invention relates to improvements in developing units which are typically positioned about a photoconductive element such as a photoconductive drum in an image forming apparatus such as a copier, facsimile machine, printer, etc.

2. Discussion of the Background

A conventional developing device for an image forming apparatus can be provided in the form of a unit having two developing rollers disposed such that each developing roller axis is supported by the housing or side plates of the unit. In this type of developing device, providing predetermined gaps between the photoconductive element, particularly a photoconductive drum, and each of the developing rollers is important in reliably obtaining a high quality copied image, and in avoiding excessive driving loads imposed upon the developing rollers during a developing operation. Of course, where only one developing roller is utilized in the developing unit, it is relatively easy to set the gap between the photoconductive drum and the developing roller. In particular, where the developing unit includes only a single developing roller, the developing unit need only ensure a predetermined gap is provided between the single developing roller and the photoconductive drum. However, where two or more developing rollers are used, and each is supported by the side plates or housing of the developing unit, it can be difficult to position the unit such that a predetermined gap is maintained between the photoconductive drum and each of the respective developing rollers. The problem of properly positioning each of the rollers with respect to the photoconductive drum can be particularly difficult as a result of errors which can occur upon setting or placing of the developing unit in the body of the image forming apparatus (such as a copying machine) and/or during assembly of the developing unit. For example, the axes of the developing rollers might not be consistent with respect to one another in the developing unit, and/or might not be consistently disposed at the exact location in the housing of the developing unit. In addition, during placement of the unit in the image forming apparatus, adjusting of the gap for one of the developing rollers can result in an improper gap setting for the other developing roller(s).

One type of conventional developing device for an image forming apparatus is disclosed in Japanese Laid Open Patent Publication No. 63-98674/88, which includes an arrangement to avoid the above-discussed problem. In this type of device, one of the developing rollers is positioned with a predetermined gap with respect to the photoconductive drum, and thereafter the unit (which includes two developing rollers) is rotated or pivoted around the axis of the first positioned roller in a predetermined direction. As a result, the other developing roller is positioned against the photoconductive drum. However, such a device requires a complicated setting action, and can incumber the design of the surrounding parts, or require a sufficient space to be accommodated with respect to the surrounding parts to accommodate the setting action. As a result, the developing device can become complicated and inefficient from a cost standpoint.

SUMMARY OF THE INVENTION

Accordingly, it is an object of the present invention to avoid the aforementioned shortcomings.

It is a further object of the present invention to provide an image forming apparatus having an improved mounting arrangement for a developing unit such that, particularly where two or more developing rollers are provided, the developing unit can be properly positioned such that a desired gap is maintained between the photoconductive drum and each of the developing rollers.

Other objects and advantages are achieved in accordance with the present invention which provides an image forming apparatus having an improved mounting arrangement for the developing unit, particularly where the developing unit includes at least two developing rollers. With the present invention, the image forming apparatus includes axis supporting members mounted thereon, with the supporting members supporting each axis of the developing rollers upon side plates which are fixed to the body of the image forming apparatus. Holes or recesses are provided in the axis supporting members, which receive each of the axes of the developing rollers. In a particularly preferred arrangement, one of the holes for receiving a developing roller axis is provided in the form of a round hole or circular hole, with the other provided in the form of an elongated circle or slot having an arcuate configuration. As a result, when the axes of the developing rollers are inserted into the holes, accurate positioning is achieved with respect to the photoconductive member, even if there is an uneven or inconsistent gap or spacing between developing rollers, or among developing units. As a result, the gap between the two developing rollers of the developing unit and the photoconductive drum is accurately maintained when the developing unit is positioned in the image forming apparatus.

BRIEF DESCRIPTION OF THE DRAWINGS

A more complete appreciation of the invention and many of the attendant advantages thereof will become readily apparent from the following detailed description, particularly when considered in conjunction with the drawings in which.

DETAILED DESCRIPTION OF THE PREFERRED EMBODIMENTS

Figure 2:
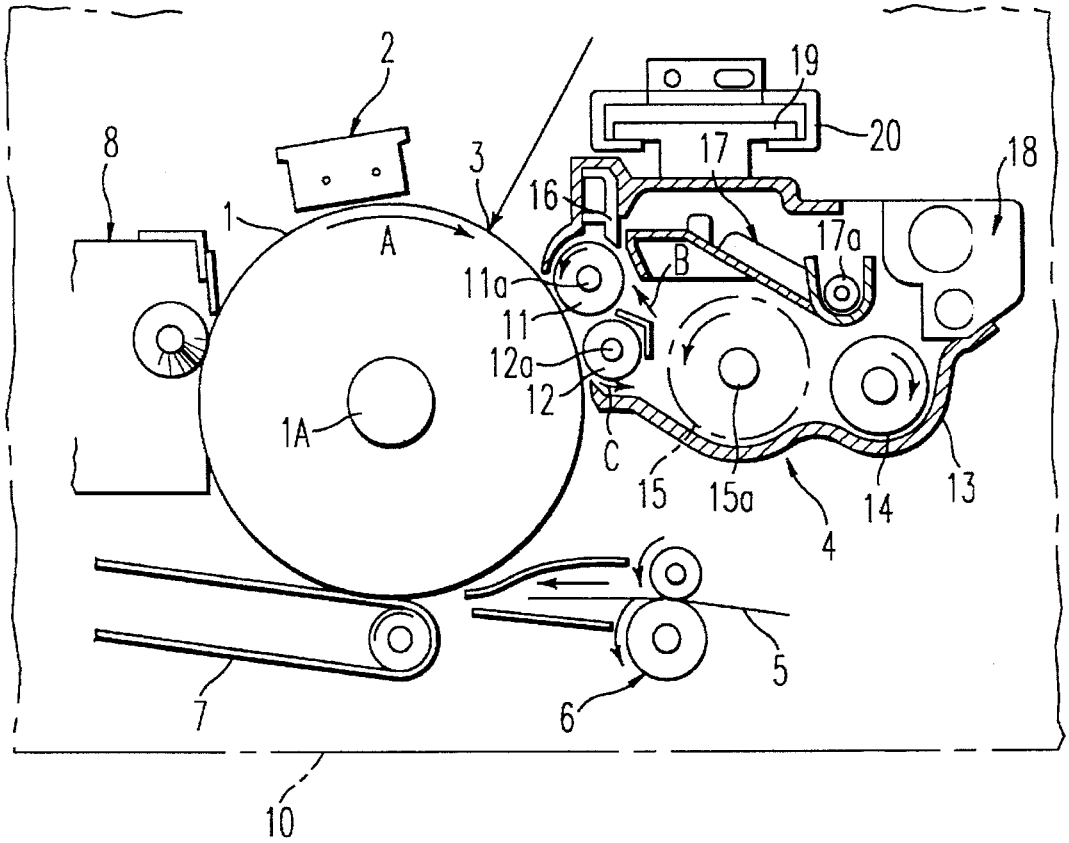
FIG. 2 is a side partial cross-sectional view of an image forming apparatus to which the present invention is applicable.

Referring now to the drawings, wherein like reference numerals designate identical or corresponding parts throughout the several views, the present invention will now be described. First, referring to FIG. 2, the overall arrangement of an image forming apparatus will be described. As shown in FIG. 2, the photoconductive drum 1 is rotated in a direction indicated by arrow A. As the drum 1 rotates, a uniform charge is applied thereto by a charger 2, followed by an exposing operation which is executed by an exposing device 3. The latent image thus formed is then developed by a developing device 4, and preferably, the developing device 4 is provided in the form of a developing unit.

In operation, a copy sheet 5 (i.e., a sheet upon which the image is to be formed) is fed from a paper cassette, not shown, to registration rollers 6, and thereafter the sheet is fed between the drum 1 and a transfer belt 7, synchronous with the rotation of the drum 1. As a result, the toner image is transferred from the drum to the copy sheet 5.

After the toner image is transferred to the copy sheet 5, the sheet is fed upon the transfer belt 7 and passes through a fixing device, not shown, and is ejected from the image forming apparatus 10. Further, after transferring of the toner image, the periphery of the drum 1 is cleaned by a cleaning device 8, and typically is provided with a discharge having a predetermined polarity by a discharging device, not shown, such that the drum 1 is ready for the next image forming operation.

As shown in FIG. 2, the developing means is typically housed in a housing or a casing 13, with the casing 13 including a two component toner disposed therein, including a toner particle an a carrier bead. The developing unit 4 is detachable with respect to the body of the image forming apparatus 10, and includes two or more developing rollers 11, 12 which carry the toner and transfer the toner to the developing section. The developing unit 4 is set onto the body of the image forming apparatus 10, such that each of the developing rollers 11, 12 face the drum 1 with a predetermined gap between the rollers 11, 12 and the drum 1 as shown in FIG. 2. By way of example, a rail member 19 can be fixed to the top of the developing casing 13, which cooperates with a guide rail 20 provided on the body of the image forming apparatus 10. With this type of arrangement, the developing unit 4 can be inserted from the front of the apparatus to the inside of the body of the image forming apparatus.

The toner mixing roller 14 and a paddle roller 15 are also disposed in the developing casing 13. These rollers mix the toner and carry the toner to the developing roller 11 in the direction shown by arrow B in the Figure. The toner is further carried by the developing rollers 11, 12, such that the toner develops the latent image formed on the drum 1 as the latent image passes through the gap in the developing area. Thereafter, the residual toner falls or passes under the developing roller 12 in a direction away from the drum 1 as shown by arrow C in FIG. 2. A doctor blade 16 can also be provided for equalizing the thickness of the toner carried by the developing roller 11. In addition, a separator 17 and screw 17*a* are typically provided for separating and mixing the toner in a direction parallel to the axis of drum 1. A toner supply hopper 18 is also typically provided for supplying the toner to the developing unit 4.

Figure 1:
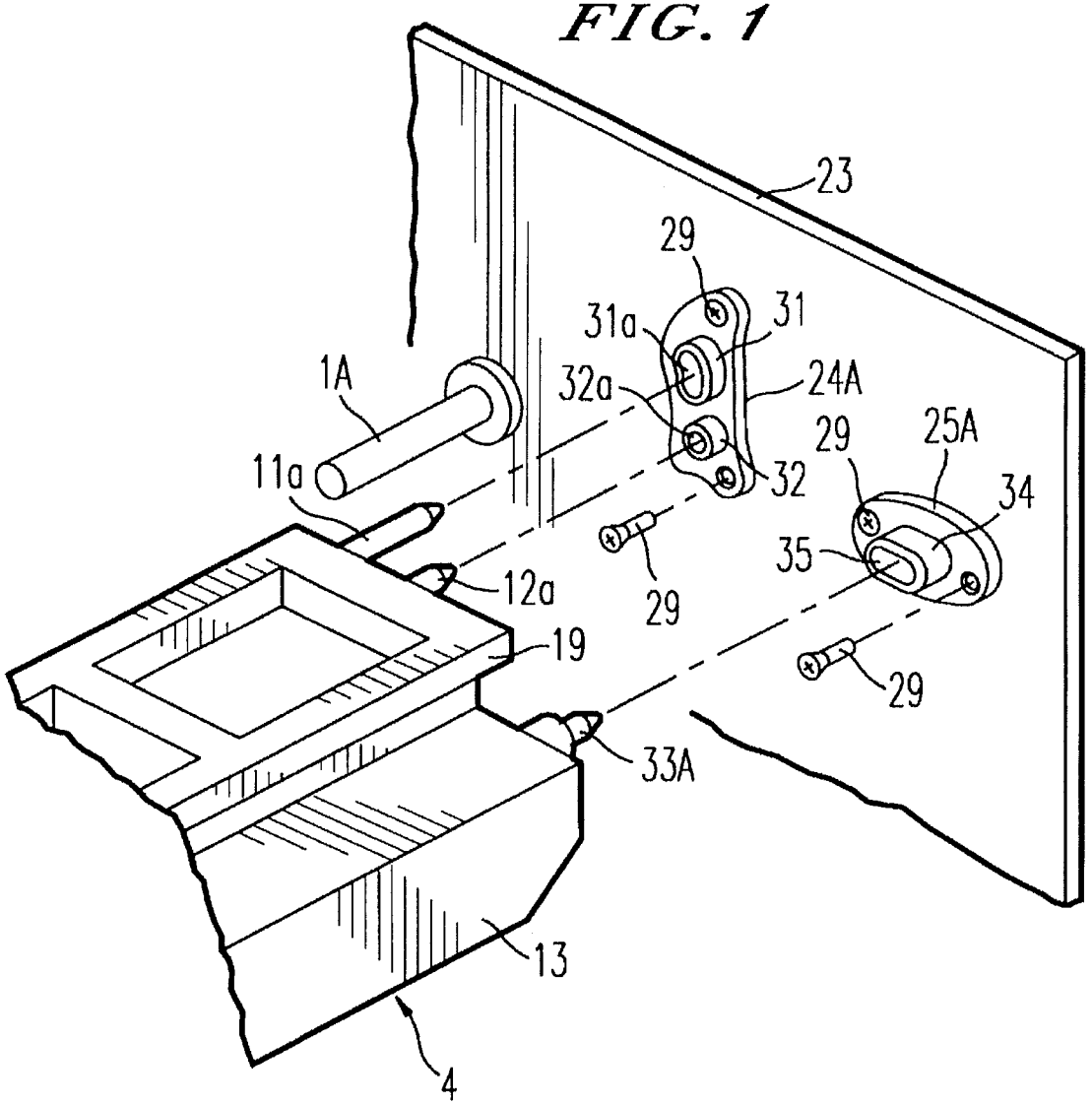
FIG. 1 is a perspective view of the mounting of a developing unit upon a side plate of the image forming apparatus in accordance with the present invention.
Figure 4:
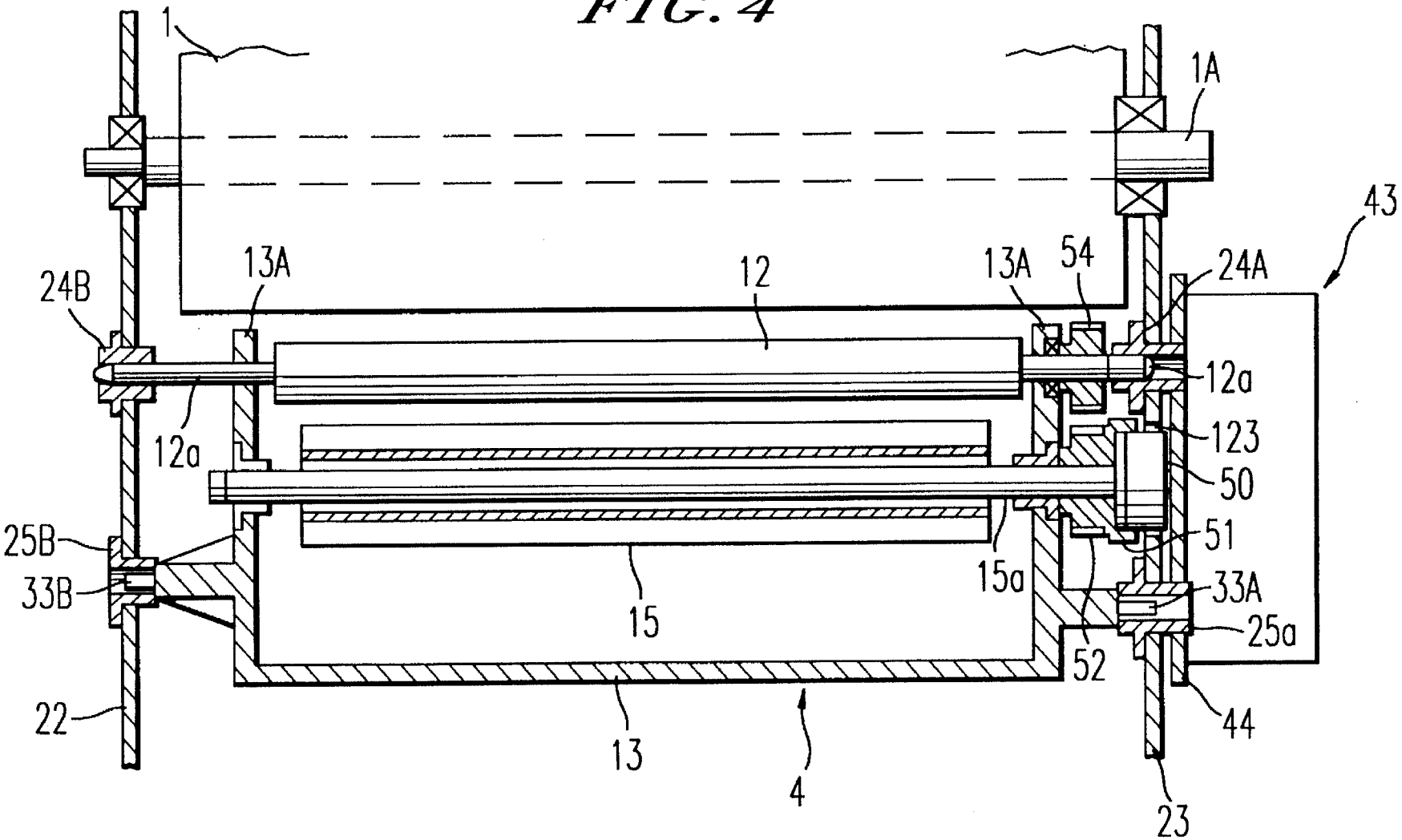
FIG. 4 is a partial cross-sectional view of a developing unit, including the drive gears, which can be utilized in accordance with the present invention.

Both axes of the developing rollers are supported by the side plate 13*a* of the developing casing 13 of the developing unit such that the developing rollers can freely rotate as shown in FIGS. 2 and 4. In addition, an axis 15*a* of the paddle roller 15 is also supported for rotation in the casing 13. As shown in FIG. 4, the body of the image forming apparatus includes a pair supporting side plates 22, 23 which support the developing unit 4 and the body of the image forming apparatus. The supporting side plate 23 as shown in FIG. 1 corresponds to the same side plate 23 as shown in FIG. 4, while the supporting side plate 22 of FIG. 4 corresponds to a side plate on a front side of the image forming apparatus which is not shown in FIG. 1. However, the construction of the side plate 22 can have the same construction as shown in FIG. 1, or more particularly, a mirror image of that shown in FIG. 1 to support the elements of the developing unit 4 in the same manner.

Figure 5:
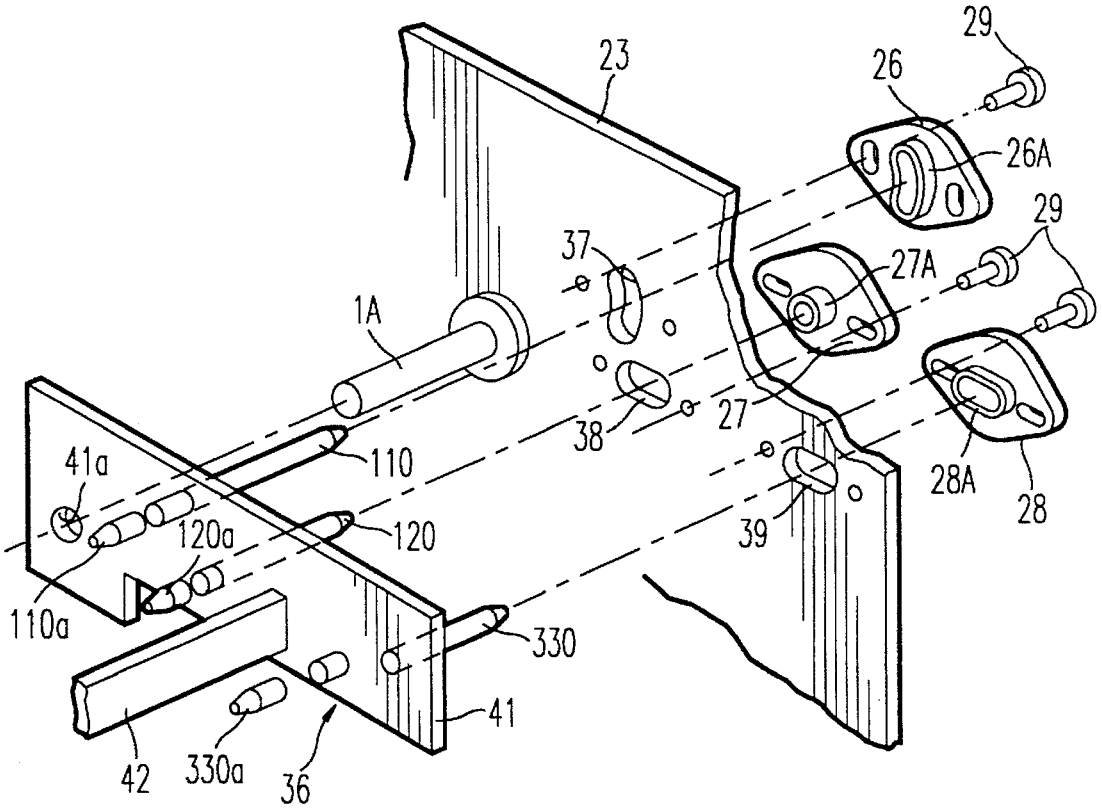
FIG. 5 is a perspective view of mounting components utilized in accordance with the present invention, as well as a jig which can be utilized for properly positioning the mounting elements or supporting members.

Each of the supporting side plates 22, 23 is mounted to a base plate fixed to the body of the image forming apparatus by a screw or other suitable connectors. In addition, the axis 1A of the drum 1 is also supported by the side plates 22, 23 (FIG. 1). As shown in FIG. 1, the axis supporting member 24A is fixed to the side plate 23, for example, by a screw 29 (FIG. 5). Thus, the axis supporting member 24A can be removed or mounted by releasing or attaching the screw 29. As discussed earlier, the same equipment is utilized for the front side support plate 22. With the arrangement of the present invention, each of the ends of the axes 11*a* and 12*a* of the developing rollers 11, 12 are supported by the axis supporting member 24A, which is fixed to the side plates 22, 23.

The inner side axis supporting member 24A will now be described. Since the supporting arrangement on the plate 22 is the same as that provided on the plate 23 (more particularly a mirror image of the same arrangement), details of the support provided on the plate 22 are not needed.

As shown in FIG. 1, bosses 31 and 32 are formed on the axis supporting member 24A in order to support each of the axes 11*a*, 12*a* of the developing rollers 11, 12. The bosses 31, 32 respectively include supporting holes or recesses 31*a*, 32*a* formed therein, which receive a respective axis of the first and second developing rollers such that each of the developing rollers 11, 12 face the photoconductive drum with a predetermined gap between each of the respective rollers and the drum 1. It is to be understood that the various holes/recesses described herein may extend partially or completely through the supporting members without departing from the present invention.

One of the supporting holes for supporting the developing rollers, for example the hole 32*a*, is provided in the form of a round or circular hole. By contrast, the supporting hole for another developing roller, for example the hole 31*a* into which the axis 11*a* of the first developing roller 11 is inserted, is provided in the form of an elongated circle or slot having an arcuate configuration, with the arc preferably having a center of rotation (i.e., an axis of the radius of the arc) at the axis 1*a* of the photoconductor of drum 1. In other words, the arcuate hole or slot preferably includes an arc which is substantially parallel to the outer circumference of the photoconductive drum 1. Thus, in accordance with the present invention, it has been recognized that even where variations in the spacing between the rollers 11, 12 can occur, each of the rollers can be properly positioned with respect to the photoconductive drum upon mounting of the developing unit on the image forming apparatus, since the round hole or round recess maintains the position of one of the developing rollers with respect to the photoconductive drum, while the elongated hole or recess maintains the position of the other developing roller with respect to the photoconductive drum while also accommodating for variations in the spacing between the developing rollers 11, 12. As should be readily apparent, since the hole 31*a* has an arcuate shape or slot surface which is equispaced from the drum 1, the desired gap between the roller 11 and drum 1 is ensured.

As shown in FIG. 4, particularly the left portion of the figure (which corresponds to the front side of the body of the image forming apparatus), the axis supporting member 24B is correspondingly fixed on the supporting side plate 22, and has the same structure as the supporting side plate 23 discussed above. Thus, both axes 11*a*, 12*a* of the developing rollers 11, 12 are supported by the respective axis supporting members 24A, 24B. Therefore, the first and second developing rollers 11, 12 are positioned with the desired predetermined gap with respect to the photoconductive drum 1, since the gaps are defined by the above-mentioned holes, each of which is disposed at a predetermined distance from the axis of the drum 1.

Although it is possible for both of the axis supporting holes 31*a*, 32*a* to be provided in the form of a circle or round hole, with the axes 11*a*, 12*a* of the developing rollers 11, 12 inserted therein, large external forces can result when the developing unit 4 is inserted utilizing such round holes. Further, if variations are present among developing units, it may be difficult to utilize the same mounting member for various developing units due to manufacturing variations. Moreover, if it is required to force the axes 11*a*, 12*a* into circular holes, the durability and/or performance of the developing unit can be diminished.

Figure 3:
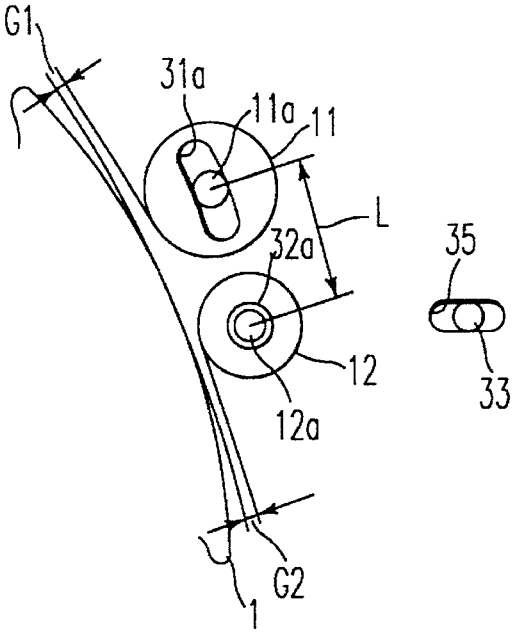
FIG. 3 is a side view showing the positional relationship of the axis of the developing rollers and the relationship of the developing rollers and photoconductive drum in accordance with the present invention.

Referring now to FIG. 3, the relative positions among the supporting holes 31*a*, 32*a*, the developing rollers 11, 12 and the drum 1 should become further apparent. As shown in FIG. 3, if the gap L between the first and second developing rollers 11, 12 varies, or is inconsistent along the axial direction, the desired gaps G1 and G2 between each of the respective rollers 11, 12 and the drum 1 is nevertheless maintained. More particularly, since both of the axis supporting members 24A and 24B ensure the accurate positioning with respect to the distance from the axis 1*a* of the drum 1 and the supporting holes 31*a* and 32*a* of the supporting members, the predetermined gaps G1 and G2 are ensured. Thus, even though the gap L may vary along the axis of the developing rollers 11, 12, or if the gap should vary from one developing unit to another, the axis 11*a* can move along the arc of hole 31*a*, and may be disposed at varying positions along the arc, while the gap G1 nevertheless remains the same. In addition, the axis of the developing roller 12 is properly positioned, since the roller 12 is inserted in the supporting hole 32*a*. Thus, both gaps G1 and G2 between the drum and each of the respective rollers 11, 12 are precisely ensured in a relatively simple mounting operation.

Variations in the spacing between the developing rollers 11, 12 can result from an imprecise formation of the developing casing 13, or in assembling of the developing rollers to the casing 13. However, such a variation does not prevent proper positioning of both of the rollers with respect to the drum, since both the front side axis and the rear side or inner side axis supporting members ensure proper positioning with respect to each of the gaps G1 and G2.

After mounting of the developing unit, if any play should exist between the axis 11*a* and the supporting hole 31*a*, the developing unit can undesirably rattle about the axis 12*a*. As a result, the quality of the toner image can be adversely affected, and can defeat the purpose of the accurate positioning. However, in accordance with a further aspect of the present invention, pins 33A and 33B are provided which protrude from the casing 13 and face the respective supporting side plates 22, 23 (FIG. 4). Further, an axis supporting member 25A is supported on the side plate 23, for example, by a screw 29. In addition, a hole 35 is provided, for example, in a boss 34 for receiving the pin 33A. The hole 35 is in the form of an elongated circle or slot extending in the horizontal direction as shown in FIG. 3, or toward the drum 1 (or an axis of the drum). Similarly, an axis supporting member 25B is fixed to the front side plate 22, and receives the pin 33B in the same manner.

In setting the developing unit 4 in a predetermined position in the body of the image forming apparatus as shown in FIG. 4, the supporting side plate 22 (not shown in FIG. 4) is removed or opened with respect to the base plate, and the developing unit 4 is inserted in a direction extending from left to right with respect to FIG. 4. As discussed earlier, a rough guiding art support can be provided by a rail/guide arrangement as shown at 19, 20 of FIG. 2. Upon insertion of the unit, each of the axes 11*a*, 12*a* of the developing rollers can be inserted into each of the axis supporting holes 31*a*, 32*a*, with the pin 33A inserted into the elongated horizontal hole 35. Thereafter, the side support plate 22 is positioned against the base plate and fixed in position with each of the roller axis 11*a*, 12*a* inserted into each of the supporting holes of the supporting member 24, and each of the pins of the elongated hole 35B of the supporting member 25B correspondingly disposed on the front side plate 22. Thus, the hole and pin arrangement 33, 35 prevents pivoting (or rotating) movement and prevents vertical movement of the unit, thus minimizing possible vibration or jiggling of the unit.

With the arrangement of the present invention, the developing unit 4 is positioned at three points, and rattling of the developing unit 4 is avoided both during operation of the machine, and while the machine is not operating. As a result, the gaps between each of the developing rollers 11, 12 and the drum 1 are maintained accurately, and a high quality toner image is reliably obtained.

In accordance with a further aspect of the present invention, the accuracy in positioning each of the axis supporting members 26, 27, and 28 with respect to the side plates 22, 23 can be easily achieved utilizing a jig as shown in FIG. 5.

The jig 36 is composed of a plate 41 having a hole 41*a* extending therethrough which receives the axis 1A of the drum 1. In addition, a handle 42 is provided for ease of handling of the plate 41. Further, the plate 41 includes pins 110, 120, 330 fixed thereto, to allow the jig to be utilized for positioning as will now be discussed. In particular, the jig 36 is inserted inside of the body of the image forming apparatus after the front supporting plate 22 is removed (or before the front plate 22 is mounted) as shown in FIG. 5. During insertion of the jig 36, each of the pins 110, 120, 330 is inserted into each of the bosses 26*a*, 27*a*, 28*a*, and at the same time, the axis 1A of the drum is inserted through the hole 41*a*. As a result, each of the axis supporting members 26, 27, 28 is positioned such that each of the axes 11*a*, 12*a* and the pin 33 will be positioned at their predetermined positions with an accurate gap provided with respect to the axis of the drum 1. Thereafter, each of the axis supporting members 26, 27, 28 are fixed (utilizing screws or other appropriate fasteners) to the supporting side plate 23. Thus, each of the axis supporting members 26, 27, 28 can be easily mounted upon the side plate 23.

Utilizing the same jig (having axes 110*a*, 120*a*, 330*a* extending from an opposite side of the plate 41), or utilizing a mirror image of the jig, the supporting members 26, 27, 28, can be disposed on the front side supporting plate 22 and fixed utilizing a screw or other appropriate fastener. Thus, each of the pins 110*a*, 120*a*, 330*a* can be inserted into each of the axis supporting holes on the front side supporting plate 22, such that each of the axis supporting members is properly positioned on the front side supporting plate 22.

The developing unit 4 can then be inserted into the body of the image forming apparatus with the front side plate 22 removed and the photoconductive drum inserted along the axis 1A. Thus, a fine positioning is achieved of the developing unit 4 with respect to the photoconductive drum. Further, utilizing the above-discussed positioning with the jig, assembly and positioning of the parts is simplified and requires only a small amount of time. The pins 33A, 33B can be formed of a synthetic resin which is elastically transformable, such that if any rattling or play should remain, it is effectively suppressed, even when subjected to external forces.

As should also be apparent from the arrangement shown in FIG. 5, the circular and arcuate hole arrangement can be formed of two pieces, FIG. 5, or of one piece as shown in FIG. 1. Similarly, the horizontal slot or plate 28 can be formed as a separate piece, or as one piece with one or more of the remaining positioning/supporting elements.

Figure 6:
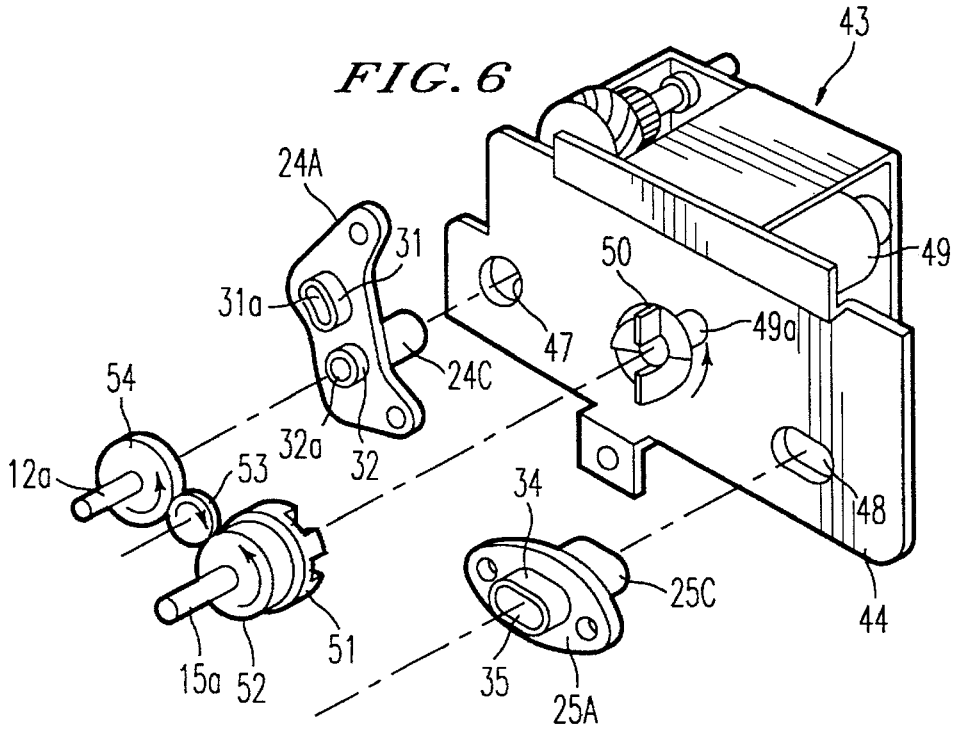
FIG. 6 is a perspective view of an alternate embodiment of the present invention which includes a coupling for the drive elements in addition to the positioning of the developing rollers.

A further embodiment of the present invention will now be described with reference to FIG. 6. As shown in FIG. 6, a driving unit 43 can also be positioned by one or more of the axis supporting members 24A, 25A. In particular, at the back side of the supporting members 24A, 25A, additional bosses 24C, 25C are provided, with each of the bosses 24C, 25C extending through the holes 47, 48 on a drive unit plate 44 of the drive unit 43 (FIGS. 4 and 6). The drive coupling 50 is then connected to an edge of a motor axis 49*a* of the drive motor 49 which protrudes from the drive unit mounting plate 44, and further, a coupling 51 is connected to the end of the roller axis 15*a* of the paddle roller 15, disposed to protrude from or at an exterior of the developing unit 4, with the drive or coupling extending through a hole 123 which extends through the support plate 23 (FIG. 4). Thus, proper positioning of the drive unit for the developing unit can also be achieved utilizing the same mounting members which properly position the developing rollers with respect to the photoconductive drum.

Thus, as the motor 49 rotates, the roller axis 15*a* of the paddle roller 15 is rotated, with the rotating force transferred through the couplings 50, 51. Further, this rotation causes rotation of the gear 52 connected to the coupling 51, which in turn results in rotation of the developing roller gear 54 via idler gear 53 in the developing casing 13. As a result, the second developing roller 12 is rotated in a clockwise direction as shown in FIG. 2. In addition, the rotation of the coupling can be similarly utilized to cause rotation of the first developing roller 11.

As should be readily apparent from the foregoing, each of the axis supporting members 24A, B and 25A, B can provide proper positioning of both the developing unit and the driving unit 43. As a result, an additional positioning device for the driving unit 43 is not needed, and the overall mounting and positioning is greatly simplified, while remaining highly reliable. Further, the positioning of the developing unit is quite precise, such that rattling or vibration of the developing unit is suppressed, and a high quality toner image can be reliably obtained. Of course, as discussed earlier, the drive unit 43 need not be positioned by the same positioning members which are utilized for positioning the developing unit 4, and the position of the driving unit 43 may be accomplished utilizing one, two, three or more supporting members, for example, separate supporting members which provide for positioning analogous to that shown in FIG. 3.

Obviously, numerous modifications and variations of the present invention are possible in light of the above teachings. It is therefore to be understood that the invention may be practiced otherwise than as specifically described herein.

What is claimed as new and desired to be secured by letters patent of the United States is:

1. An image forming apparatus comprising:

a photoconductive drum rotatable about an axis;

a developing unit having first and second axis members protruding therefrom, with each of said first and second axis members protruding from first and second sides of said developing unit, said developing unit further including first and second developing rollers respectively mounted upon said first and second axis members;

first and second side plates upon which said developing unit is supported;

first and second supporting recesses disposed on each of said first and second side plates for respectively receiving said first and second axis members, wherein said first recess is an elongated arcuate slot in which a radius of curvature of said elongated arcuate slot extends from said axis of said photoconductive drum such that said elongated arcuate slot extends parallel to an outer circumference of said photoconductive drum, and wherein said second recess is a circular opening, wherein desired spacings of said first and second axis members with respect to said photoconductive drum are maintained despite variations in a spacing between said first and second axis members.

2. The image forming apparatus of claim 1, wherein said first and second supporting recesses are disposed on a support member mounted on each of said first and second side plates.

3. The image forming apparatus of claim 1, wherein said first and second supporting recesses are, respectively, disposed on first and second support members mounted on each of said first and second side plates.

4. The image forming apparatus of claim 1, wherein on said first side plate said first and second recesses are disposed on at least one support member which is mounted to said first side plate, said image forming apparatus further including a drive unit for at least one developing roller of said developing unit, said at least one support member including means for positioning said drive unit.

5. The image forming apparatus of claim 1, wherein said first and second recesses disposed on said first side plate are disposed on at least one support member connected to said first side plate, said at least one support member including at least one boss which extends through said first side plate, and wherein said image forming apparatus includes a drive unit for driving said first and second developing rollers, said drive unit mounted on an opposite side of said first side plate with respect to said developing unit, and wherein said drive unit includes an aperture through which said at least one boss extends, whereby said drive unit is positioned by said boss.

6. An image forming apparatus comprising:

a developing unit having first and second axis members protruding therefrom, with each of said first and second axis members protruding from first and second sides of said developing unit, said developing unit further including first and second developing rollers respectively mounted upon said first and second axis members;

first and second side plates upon which said developing unit is supported;

first and second supporting recesses disposed on each of said first and second side plates for respectively receiving said first and second axis members, wherein said first recess has an arcuate shape, and wherein said second recess is a circular opening;

the apparatus further including a third axis member protruding from said first and second sides of said developing unit, and a third supporting recess on each of said first and second side plates for receiving said third axis member.

7. The image forming apparatus of claim 6, wherein said third supporting recess is in the form of an elongated slot having a length extending in a first direction and a width extending in a second direction, and said length is larger than said width, said width having a size substantially equal to a diameter of said third axis member.

8. The image forming apparatus of claim 7, wherein said first direction is horizontal.

9. The image forming apparatus of claim 7, including a photoconductive member in the form of a photoconductive drum which rotates about a drum axis, and wherein said first direction extends toward said drum axis.

10. The image forming apparatus of claim 7, wherein said first recess has a width which is substantially equal in size to a diameter of said first axis member, said first recess having a length larger than said width of said first recess.

11. The image forming apparatus of claim 10, including a photoconductive member having an outer surface, said first recess including a surface extending along said length of said first recess which is equispaced from said outer surface of said photoconductive member along said length of said first recess.

12. The image forming apparatus of claim 11, wherein said photoconductive member is a photoconductive drum having a drum axis, and said arcuate shape of said first recess has a radius of curvature extending from an axis which is coaxial with said drum axis.

13. An image forming apparatus comprising:

a developing unit having first and second axis members protruding therefrom, with each of said first and second axis members protruding from first and second sides of said developing unit, said developing unit further including first and second developing rollers respectively mounted upon said first and second axis members;

first and second side plates upon which said developing unit is supported;

first and second supporting recesses disposed on each of said first and second side plates for respectively receiving said first and second axis members, wherein said first recess has an arcuate shape, and wherein said second recess is a circular opening;

wherein said developing unit further includes a third axis member extending from said first and second sides of said developing unit and wherein a third recess is disposed on each of said first and second side plates for receiving said third axis member, said third recess being an elongated slot.

14. The image forming apparatus of claim 13, wherein said elongated slot extends horizontally.

15. An image forming apparatus comprising:

a developing unit having first and second axis members protruding therefrom, with each of said first and second axis members protruding from first and second sides of said developing unit;

first and second side plates upon which said developing unit is supported;

first and second supporting recesses disposed on each of said first and second side plates for respectively receiving said first and second axis members, said first recess having an arcuate shape;

wherein said developing unit further includes a third axis member extending from said first and second sides of said developing unit and wherein a third recess is disposed on each of said first and second side plates for receiving said third axis member, said third recess being an elongated slot; and wherein said third axis member supports a paddle roller inside of said developing unit.

16. The image forming apparatus of claim 15, wherein said second recess is round.

17. An image forming apparatus comprising:

a developing unit having first and second axis members protruding therefrom, with each of said first and second axis members protruding from first and second sides of said developing unit;

first and second side plates upon which said developing unit is supported;

first and second supporting recesses disposed on each of said first and second side plates for respectively receiving said first and second axis members, said first recess having an arcuate shape;

the apparatus further including at least one support plate disposed on said first and second side plates, said at least one support plate having at least one of said first and second recesses disposed thereon, said image forming apparatus further including a jig for positioning said at least one support plate, said jig including at least one jig plate and at least one jig axis member extending from said jig plate and into one of said first and second recesses, said jig further including an aperture through which a drum axis of a photoconductive drum extends.

18. The image forming apparatus of claim 17, wherein said jig includes first and second jig axes which are received by said first and second recesses.

19. An image forming apparatus comprising:

first and second side plates;

a photoconductive drum supported upon a drum axis member;

a developing unit including first and second developing rollers, respectively, mounted upon first and second axis members, said first and second axis members extending through a housing of said developing unit on first and second sides of said developing unit which are respectively adjacent said first and second side plates;

first and second recesses disposed on each of said first and second side plates which, respectively, receive said first and second axis members, said first recess provided in the form of an elongated slot, said second recess provided in the form of a circular opening;

wherein said first and second recesses disposed on said first side plate are formed in at least one support member mounted on said first side plate, said image forming apparatus including a drive unit for driving said first and second developing rollers, said drive unit connected to said at least one support member, whereby said drive unit is positioned by said at least one support member; and wherein said at least one support member includes a boss which extends through said first side plate, and said drive unit includes an aperture which receives said boss.

20. The image forming apparatus of claim 19, wherein said elongated slot of said first recess is arcuate.

21. The image forming apparatus of claim 20, further including a third recess disposed on each of said first and second side plates, said developing unit further including a third axis member extending from said housing, with said third axis member received by said third recess.

22. The image forming apparatus of claim 21, wherein said third recess is an elongated horizontal slot.

23. The image forming apparatus of claim 22, wherein said first, second, and third recesses are formed in respective first, second, and third support plates mounted on each of said first and second side plates.

24. An image forming apparatus comprising:

first and second side plates;

a photoconductive drum supported upon a drum axis member;

a developing unit including first and second developing rollers, respectively, mounted upon first and second axis members, said first and second axis members extending through a housing of said developing unit on first and second sides of said developing unit which are respectively adjacent said first and second side plates;

first and second recesses disposed on each of said first and second side plates which, respectively, receive said first and second axis members, said first recess provided in the form of an arcuate elongated slot, said second recess provided in the form of a circular opening;

a third recess disposed on each of said first and second side plates, said developing unit further including a third axis member extending from said housing, with said third axis member received by said third recess, wherein said third recess is an elongated horizontal slot; and wherein said first, second, and third recesses are formed in respective first, second, and third support plates mounted on each of said first and second side plates;

the apparatus further including a jig for positioning at least two of said first, second and third support plates, said jig including a jig plate and first and second jig axis members extending from said jig plate.

25. An image forming apparatus comprising:

first and second side plates;

a photoconductive drum supported upon a drum axis member;

a developing unit including first and second developing rollers, respectively, mounted upon first and second axis members, said first and second axis members extending through a housing of said developing unit on first and second sides of said developing unit Which are respectively adjacent said first and second side plates;

first and second recesses disposed on each of said first and second side plates which, respectively, receive said first and second axis members, said first recess provided in the form of an arcuate elongated slot, said second recess provided in the form of a circular opening;

a third recess disposed on each of said first and second side plates, said developing unit further including a third axis member extending from said housing, with said third axis member received by said third recess, wherein said third recess is an elongated horizontal slot; and wherein said first, second, and third recesses are formed in respective first, second, and third support plates mounted on each of said first and second side plates;

the apparatus further including a jig for positioning each of said first, second and third support plates, said jig including first, second and third jig axis members which are respectively, received by said first, second and third recesses.

26. The image forming apparatus of claim 25, wherein said jig further includes an aperture through which said drum axis member extends.

* * * * *